US005896866A

United States Patent [19]

Quennessen

[11] Patent Number: 5,896,866

[45] Date of Patent: Apr. 27, 1999

[54] CASE FOR COSMETIC PRODUCTS HAVING SEALED CLOSURE

[75] Inventor: Bernard Quennessen, Succasunna, N.J.

[73] Assignee: Qualipac, Neuilly sur Seine, France

[21] Appl. No.: 09/040,526

[22] Filed: Mar. 18, 1998

[30] Foreign Application Priority Data

Mar. 26, 1997 [FR] France ..... 97 03704

[51] Int. Cl.[6] ..... A45D 33/00

[52] U.S. Cl. ..... 132/293; 132/294; 132/315; 206/581; 206/823

[58] Field of Search ..... 132/293, 294, 132/295, 296, 297, 298, 299, 300, 301, 315; 220/326, 324, 4.24, 4.22, 4.23, 4.25; 292/83, 254, DIG. 37, 307 B; 206/581, 823

[56] References Cited

U.S. PATENT DOCUMENTS

| | | | |
|---|---|---|---|
| 2,421,646 | 6/1947 | Pepin | 132/293 |
| 2,424,817 | 7/1947 | Grassi | 132/293 |
| 3,776,245 | 12/1973 | Hayes et al. | 132/293 |
| 3,911,936 | 10/1975 | Kingsford | 132/293 |
| 4,060,173 | 11/1977 | Dahl | 220/4 |
| 4,399,826 | 8/1983 | Ogasawara | 132/293 |
| 4,454,889 | 6/1984 | Contreras, Sr. . | |
| 4,586,519 | 5/1986 | Seidler et al. | 132/293 |
| 5,598,929 | 2/1997 | Jensen et al. | 206/527 |
| 5,682,910 | 11/1997 | Kizawa et al. | 132/293 |

FOREIGN PATENT DOCUMENTS

| | | |
|---|---|---|
| 1190868 | 2/1963 | Germany . |
| 9302179 | 7/1994 | Germany . |
| 2137594 | 10/1984 | United Kingdom . |
| 8707483 | 12/1987 | WIPO . |

*Primary Examiner*—Gene Mancene
*Assistant Examiner*—Pedro Philogene
*Attorney, Agent, or Firm*—Rothwell, Figg, Ernst & Kurz

[57] ABSTRACT

A case is provided for containing a product which is susceptible of deterioration in the air, and more particularly a cosmetic product. The case comprises a base for containing the cosmetic product, a cover articulated relative to the base, a locking device that maintains the cover in a closed position, and two substantially cylindrical, coaxial skirts, with a lower skirt extending from the base and an upper skirt extending from the cover, with the lower skirt capable of being inserted concentrically into the upper skirt when the cover is in a closed position, wherein when the cover is in a closed position the lower skirt is compressed axially and is therefore deformed radially in order to create a sealing contact between the upper skirt and the lower skirt.

15 Claims, 2 Drawing Sheets

CASE FOR COSMETIC PRODUCTS HAVING SEALED CLOSURE

BACKGROUND OF THE INVENTION

1. Field of the Invention

The present invention relates to a case, in particular for cosmetic products, such as a make-up case ensuring excellent, sealed closure.

2. Description of the Related Art

A product of that type very often deteriorates when exposed to air and is sometimes volatile. A case has indeed already been proposed, in particular in WO-A-87 07483 or in U.S. Pat. No. 4,586,519, comprising:

a base for containing the cosmetic product, a cover articulated relative to the base, locking means in order to maintain the cover and the base in a position in which the case is closed, sealing means comprising two substantially cylindrical skirts, one connected to the base and one to the cover, and being inserted one inside the other when the case is in the closed position.

However, the contact between the two skirts producing the seal causes them to become jammed, with the result that, in order to separate the two skirts and open the case, it is then necessary to apply a relatively great force which is hardly compatible with the demands of the market in question.

Therefore, it has not been known hitherto how to produce a sealed closure of a cover folded onto the base of a case maintained in the closed position, which is effective, ergonomic (in particular, easy to open), convenient to produce and substantially inexpensive.

SUMMARY OF THE INVENTION

The invention allows the problem to be solved by virtue of the fact that:

one (at least) of the skirts has two substantially cylindrical walls connected to one another to form a U, the skirt is compressed between the base and the cover when the case is in the closed position, under the effect of the compression stress, at least one of the walls is compressed along its generating lines and is deformed (in the direction towards the other skirt) perpendicularly to its generating lines in order to come into close contact with the other skirt.

Deforming perpendicularly to its generating lines at least one of the walls of the skirt in order to produce the seal with the other skirt allows a satisfactory seal to be produced and the play which exists between the skirts in the absence of compression stress to be increased. In this manner, the sliding action between the skirts is promoted and, therefore, the force necessary to open the case after removing the stress is reduced.

Applying compression stress to the U-shaped skirt, in the region of its bottom portion, causes the limbs of the U formed by the walls to move apart. The wall coming into contact with the other skirt is deformed to fit the profile of the other skirt and, with it, defines a contact surface that is not as small as a single line. As a result, the seal between the two skirts is greatly improved.

Moreover, the compression stress exerted on the skirt will promote the opening of the case when the case is unlocked.

In order further to improve the seal, the invention proposes that the wall comprise an insert part defined by the portion of the wall where the skirts are inserted one inside the other and that the main portion of the insert part be deformable. Advantageously, all of the insert part is deformable. In this manner, the contact surface is even larger and the seal even more effective or, to put it another way, the compression force required to obtain a satisfactory seal is reduced.

According to an advantageous feature of the invention which aims to facilitate deformation of one of the skirts in the direction towards the other in order to come into contact with it, the invention proposes that the deformable skirt have a substantially cylindrical and slightly rounded (bulging) shape.

According to an advantageous embodiment, the invention proposes that the case comprise a support having, on the exterior, the U-shaped skirt and a plate for supporting a product or a product receptacle, the U-shaped skirt then being inserted into the other skirt.

Advantageously, the wall of the U-shaped skirt coming into contact with the other skirt rests on the base.

In addition, it is advantageously positioned around a rib relative to the base.

According to another advantageous feature of the invention, the U-shaped skirt is connected to the base and is inserted in the other skirt, which is connected to the cover.

Advantageously, the skirts have cross-sections such that, in the absence of stress being applied thereto, they can be inserted one inside the other whilst having strictly positive play between one another. Therefore, it will require practically no more force to separate the two skirts when opening the case.

BRIEF DESCRIPTION OF THE DRAWINGS

The invention will become even clearer in the following description which is given with reference to the appended drawings in which:

FIG. 1 is a section through a device forming a make-up case according to the invention, in the open position, FIG. 2 is a section through the device in FIG. 1, in the closed position, FIG. 3 is an enlarged view of the portion marked III in FIG. 2, at a point just before the case is completely closed, FIG. 4 is also an enlarged view of the portion marked III in FIG. 2, the case being in the closed position.

DETAILED DESCRIPTION OF THE INVENTION

Figure 1:
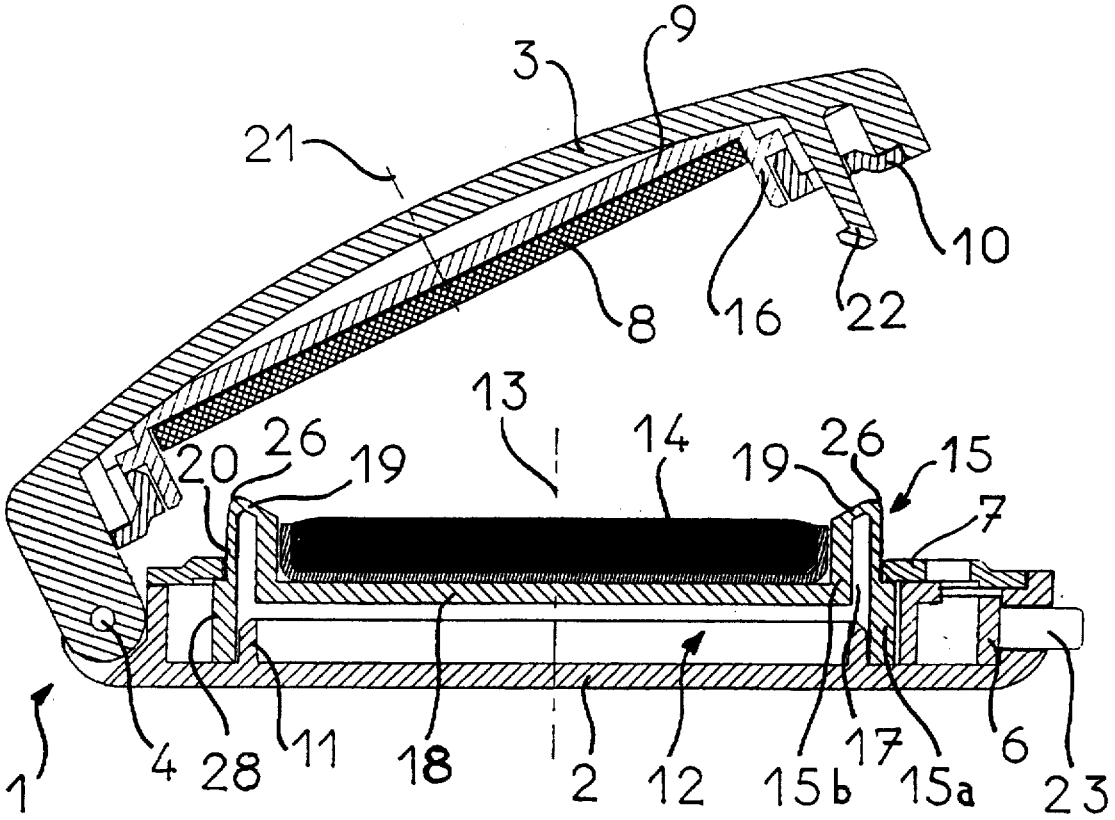
FIGS. 1, 2, 3 and 4 are diametral sections through a device forming a make-up case according to the invention, the sections being in a plane perpendicular to the articulation axis of the cover relative to the base.
Figure 2:
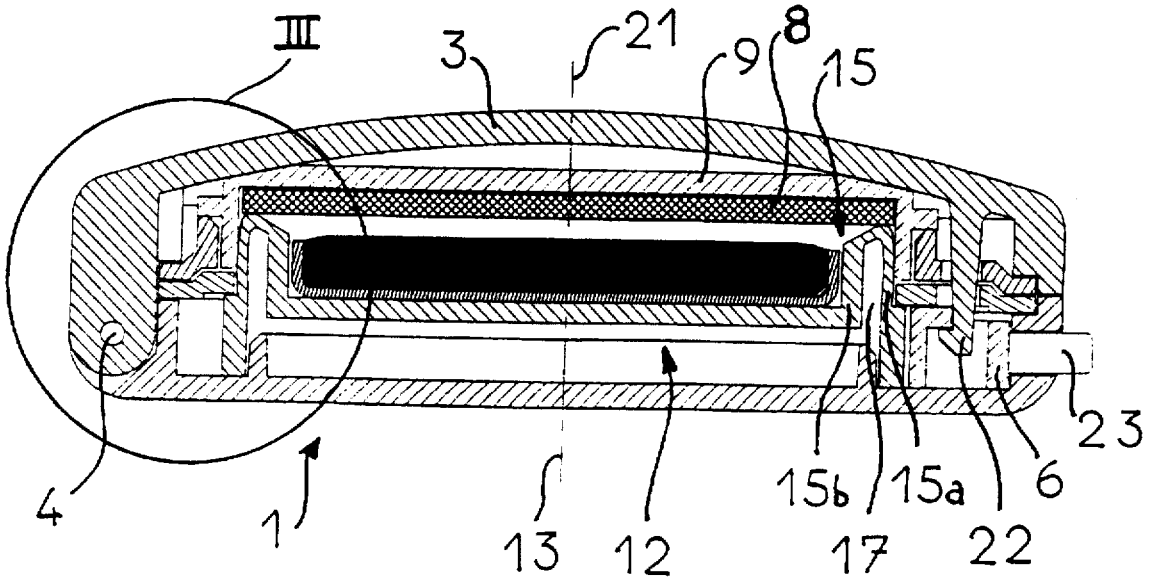

With reference to the drawings, there will be observed in particular the case 1 comprising its base 2 which is substantially flat and on which the cover 3 is articulated about a hinge axis 4, which is substantially parallel with the plane of the base.

A mirror 8 is arranged in a support 9 maintained on the cover 3 by a cover embellisher 10 and having a skirt 16. The skirt has a substantially cylindrical shape, here of circular cross-section, and has an axis of rotation 21 parallel with its generating lines. The cover 3 has a hook 22 which hooks into a retention device 6 connected to the base 2 and controlled by a control button 23.

The case encloses a support 12 forming a dish-carrier, here having an axis of rotational symmetry 13 which is substantially perpendicular to the general plane of the base.

The support has, on the exterior, a skirt 15 having a substantially cylindrical shape, here of circular cross-section, and a disc-shaped plate 18.

The skirt 15 has two substantially cylindrical walls 15*a*, 15*b* in the form of two portions of a cylinder, leaving a hollow space 17 between them. They are connected to one another in a junction region 19 and have, when viewed in cross-section, a U-shape whose bottom portion, arranged facing the cover, projects towards the cover by protruding relative to the base. The generating lines of the two walls of the skirt 15 are parallel with the axis 13. The outer wall 15*a* has, at its upper portion, an insert part 20 to be inserted inside the skirt 16 of the cover. The insert part 20 is deformable and slightly rounded.

The wall 15*a* has, at its lower portion, a reinforced part 28 which is thicker and substantially non-deformable in comparison with the insert part 20. The support 12 rests on the base 2 of the case via the reinforced part 28 of the wall 15*a* of the skirt, which is positioned relative to the base around a rib 11 protruding from the base 2. The support 12 is retained on the base by a base embellisher 7 forming a panel. The plate 18 supports a receptacle 5 for containing a product 14 arranged in the case.

During closure movement, the cover 3 and, in particular, its skirt 16 approach the base 2 and, in particular, the base's skirt 15. During that approach, the axes 13 and 21 draw nearer to one another until they coincide.

Figure 3:
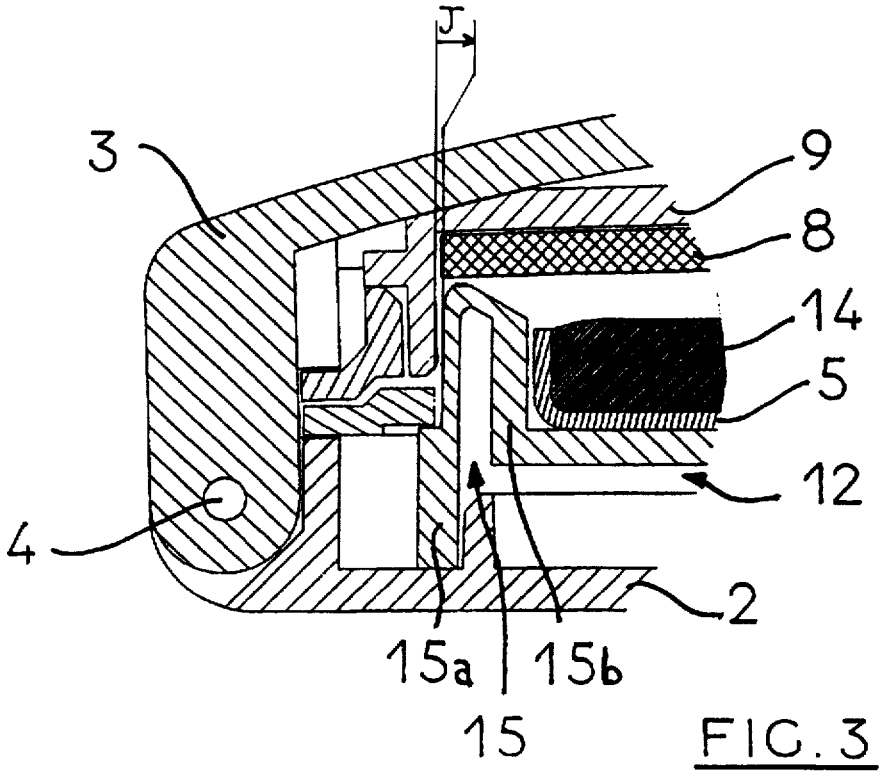
Figure 4:
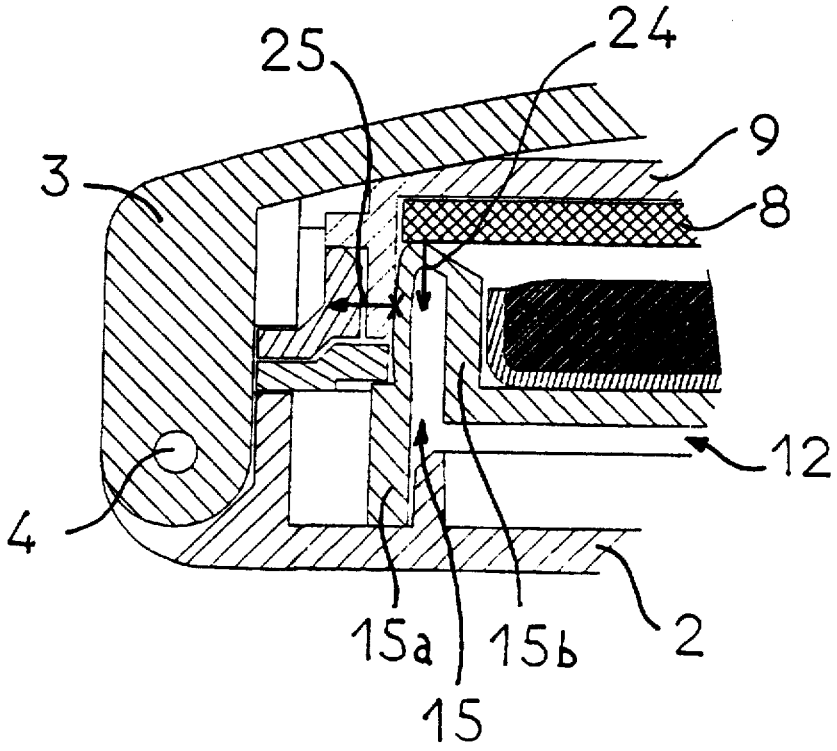

The skirt 15 has, perpendicularly to its axis 13, outer dimensions which are smaller than the inner dimensions of the skirt 16, perpendicularly to its axis 21 (here the outside diameter of the skirt 15 is smaller than the inside diameter of the skirt 16). Therefore, as illustrated in FIG. 3, when the case is not completely closed, that is, if the cover is not pressed against the skirt 15, the skirt 15 is inserted (partially) inside the skirt 16 and there is play J between the skirt 15 and the skirt 16 inside which it is inserted. The play allows effortless sliding between the two skirts 15, 16. The play is not the same around the entire periphery of the skirts if they are not completely co-axial and has an average value of a few tenths of a millimeter.

The insertion of the skirt 15 inside the skirt 16 is promoted by the slightly rounded shape of the skirt 15 and by its entry chamfering 26 formed on the outer wall 15*a*, near to the junction region 19. If there is a slight alignment error between the axes 13 and 31, the error is eliminated by the propensity of each of the two skirts 15 and 16 to be deformed under the effect of the other and, in particular, by the flexibility of the skirt 15 which ensures self-centring with the skirt 16.

When the closing of the case is continued, the cover 3, here via the mirror 8, rests on the skirt 15 in the area of the junction region 19 between the two walls 15*a*, 15*b*. As the other end of the skirt 15 is resting on the base 2, the outer wall 15*a* is compressed axially and is deformed radially, as illustrated by the arrow 25, under the effect of the compression stress, illustrated by the arrow 24, in the direction towards the skirt 16 arranged around it. The skirt 15 thus exerts an increasing force on the skirt 16 as the case closes.

When the case is completely closed, the hook 22 is retained in the retention device 6 and the receptacle 5 is isolated from the outside by means of radial, annular contact between the skirt 15 and the skirt 16. The isolation is completed by the axial, annular contact between the skirt 15 and the cover 3 in the area of the junction region 19 of the skirt.

In order to open the case, the control button 23 is pressed, which releases the hook 22 by the sliding of the retention device 6. The compressed skirt 15, tending to relax, exerts a force between the base and the cover which causes the case to open. As the force due to the decompression of the skirt is greater than the frictional force due to the radial stress exerted by the skirt 15 against the skirt 16, opening the cover requires no effort.

The supports 9 and 12, or at least the skirts 15, 16, are advantageously produced from a semi-rigid plastics material which will withstand numerous deformations, for example based on low-density polyethylene (LDPE) or polypropylene (PP) with additives promoting their relative sliding. They may be advantageously produced by injection.

The other elements of the case (with the exception of the mirror) are advantageously produced from a material having an attractive appearance and good resistance to shocks, for example from acrylonitrile butadiene styrene (ABS), from acrylonitrile styrene (ANS), from polymethyl methacrylate (PMMA), or even from polyoxymethylene such as DELRIN® for the control button.

Of course, there are numerous variants possible for the embodiment described.

Thus, although it has been provided that the sealed closure between the cover and the base be brought about by a cylindrical wall connected to the base being inserted into a wall connected to the cover and being rounded in order to come into contact therewith, it would, in particular, be possible to have an arrangement such that the wall connected to the cover curves inwardly in order to clamp the wall connected to the base, or such that the wall connected to the base surrounds the wall connected to the cover, or a combination of those possibilities.

It would also be possible to provide other means of rounding or inwardly curving a skirt. In particular, it would be possible to produce either an annular rib or an annular groove, or both in the skirt.

I claim:

1. Case for containing a product which is susceptible of deterioration in the air, in particular a cosmetic product, comprising:

a base for containing the cosmetic product, a cover articulated relative to the base, locking means for releasably maintaining the cover in a closed position on the base, and two substantially cylindrical, coaxial skirts, with a lower skirt extending from the base and an upper skirt extending from the cover, with one of the skirts capable of being inserted concentrically into the other skirt when the cover is in the closed position, wherein when the cover is in the closed position said one skirt is compressed axially and is therefore deformed radially in order to create a sealing contact between the upper skirt and the lower skirt.

2. Case according to claim 1, wherein an upper surface of said one skirt has a slightly rounded shape.

3. Case according to claim 1, wherein the base includes a plate for supporting the product formed as a bottom surface of the lower skirt.

4. Case according to claim 1, wherein the base further comprises a circular rib extending from the base, concentric with the lower skirt, with the circular rib positioning the lower skirt relative to the base.

5. Case according to claim 1, wherein in the absence of an axial compression being applied onto the lower skirt, the lower skirt can be inserted inside the upper skirt without an outer circumferential surface of the lower skirt contacting an inner circumferential surface of the upper skirt.

6. Case according to claim 1, wherein the lower skirt is produced from low-density polyethylene.

7. Case according to claim 1, wherein the lower skirt is produced from polypropylene.

8. Case according to claim 1, wherein the upper skirt is produced from low-density polyethylene.

9. Case according to claim 1, wherein the upper skirt is produced from polypropylene.

10. Case according to claim 1, wherein the lower skirt is produced from a flexible material.

11. Case according to claim 1, wherein the lower skirt is insertable into the upper skirt, and the lower skirt further comprises:

an inner substantially cylindrical wall, and an outer substantially cylindrical wall, coaxial with the inner wall, with the inner wall and the outer wall connected to one another to form a u-shaped cross-section of the lower skirt.

12. Case according to claim 1, wherein the axial compression of said one skirt is performed by contact between the top surface of the lower skirt and an inner surface of the cover.

13. Case according to claim 11, wherein the axial compression of the lower skirt consequently causes the radial deformation of the lower skirt.

14. Case according to claim 11, wherein the radial deformation occurs in the outer wall of the lower skirt.

15. Case according to claim 1, wherein the locking means further comprises:

a hook depending from the cover, a retention device connected to the base, in which the hook may be retained, and a control button formed on the retention device, with the control button capable of releasing the hook from the retention device when the control button is depressed.

* * * * *